United States Patent [19]

Off et al.

[11] 4,365,355

[45] Dec. 28, 1982

[54] PATCH POCKET AND FLAP CONSTRUCTIONS

[75] Inventors: Joseph W. A. Off, Irving; Judson H. Early, Dallas, both of Tex.

[73] Assignee: Haggar Company, Dallas, Tex.

[21] Appl. No.: 269,688

[22] Filed: Jun. 2, 1981

Related U.S. Application Data

[63] Continuation of Ser. No. 948,680, Oct. 5, 1978, abandoned.

[51] Int. Cl.[3] ..... A41D 27/20

[52] U.S. Cl. ..... 2/247

[58] Field of Search ..... 2/247, 275, DIG. 6; 112/403

[56] References Cited

U.S. PATENT DOCUMENTS

| | | | |
|---|---|---|---|
| 1,260,217 | 3/1918 | Levy . | |
| 1,928,838 | 10/1933 | Marcus . | |
| 2,011,958 | 8/1935 | Vizard . | |
| 2,323,342 | 7/1943 | McManus et al. . | |
| 2,403,694 | 7/1946 | Vizard . | |
| 2,618,333 | 11/1952 | Judd . | |
| 2,840,824 | 7/1958 | Horner | 2/247 |
| 3,018,486 | 1/1962 | Buckspan . | |
| 3,137,865 | 6/1964 | Evans et al. | 2/247 |
| 3,168,749 | 2/1965 | Cala . | |
| 3,451,065 | 6/1969 | Augustin . | |
| 3,540,975 | 11/1970 | Wright et al. . | |
| 3,560,292 | 2/1971 | Butter . | |
| 3,564,615 | 2/1971 | Jacobson . | |
| 3,566,412 | 3/1971 | Myles . | |
| 3,624,686 | 11/1971 | Beals . | |
| 3,719,955 | 3/1973 | Hrubecky . | |
| 3,725,959 | 4/1973 | Cruden . | |
| 3,744,059 | 7/1973 | Hayes . | |
| 3,777,313 | 12/1973 | Bergsten et al. . | |
| 3,794,554 | 2/1974 | Caring . | |
| 3,840,901 | 10/1974 | Eyster | 2/247 |
| 3,861,974 | 1/1975 | Trombly . | |
| 3,870,000 | 3/1975 | Castany Ferre et al. . | |
| 3,881,041 | 4/1975 | Glienke . | |
| 4,263,678 | 4/1981 | Off | 2/247 |

FOREIGN PATENT DOCUMENTS

| | | |
|---|---|---|
| 603248 | 6/1948 | United Kingdom . |
| 1072539 | 1/1966 | United Kingdom . |
| 1258330 | 12/1971 | United Kingdom . |
| 1479173 | 7/1977 | United Kingdom . |
| 1494922 | 12/1977 | United Kingdom . |
| 2001237A | 1/1979 | United Kingdom . |

*Primary Examiner*—Peter P. Nerbun

*Attorney, Agent, or Firm*—Richards, Harris & Medlock

[57] ABSTRACT

In a method of constructing patch pockets, adhesive (16) is provided adjacent to the bottom and side edges of a patch pocket blank (10). Preferably, the adhesive (16) is located on the obverse side so that inward folding of the edges orients said adhesive in the reverse direction. The folded patch pocket blank (10) is positioned against a garment (22) and the adhesive (16) is activated to effect bonding. If desired, a stitch (24) can be added along the edges of the adhesively secured pocket.

In a method of constructing flaps, a flap blank (30) is provided with adhesive (35) adjacent to the top edge. Preferably, the adhesive (35) is provided on the obverse side so that downward folding of the top edge orients the adhesive in the reverse direction. The flap blank (30) is positioned against a garment (22) and the adhesive (35) is activated to effect bonding. If desired, a stitch (38) can be added along the top edge of the flap.

4 Claims, 18 Drawing Figures

PATCH POCKET AND FLAP CONSTRUCTIONS

This is a continuation of application Ser. No. 948,680 filed Oct. 5, 1978 (now abandoned).

TECHNICAL FIELD

The present invention relates generally to a method of constructing pockets for garments. More particularly, this invention concerns a method of constructing patch pockets and flaps by utilizing adhesives.

BACKGROUND ART

In the manufacture of garments, pockets are provided chiefly for carrying useful items. Such useful items can include, for example, keys, money, wallet, handkerchief and so forth. The pockets are integrated into the garment and take the general form of a pouch open at one end for convenient access to the contents.

There are two basic types of pockets: the standard pocket and the patch pocket. The standard pocket is located on the inside of the garment, which includes a pocket slot for access thereto. A standard pocket thus occupies a concealed and protected location in the garment.

In contrast to the standard pocket, a patch pocket is located on the outside of the garment. In its simplest form, a patch pocket comprises a layer or patch of material sewn only at the bottom and side edges to the garment so that articles can be received therebetween. Patch pockets are most popular in less formal garments such as shirts, trousers, jeans and the like. Patch pockets are also very popular with jackets, sport coats and so on. In many cases, a flap is provided on the garment to cover the open end of the patch pocket. While the standard pocket is relatively more complex and time-consuming, the construction of patch pockets and flaps also involves numerous manual operations including material cutting, positioning, sewing and trimming. For example, the material turnunder in a patch pocket causes unsightly puckering which must be remedied. Such manual operations are time-consuming and tend to increase the cost of garment production.

As an alternative to traditional tailoring and sewing procedures, there have been some efforts directed to the use of adhesives in garment construction. For example, in copending application Ser. Nos. 905,054 and 138,080, now U.S. Pat. Nos. 4,156,293 and 4,321,710, respectively, each of which is assigned to the assignee hereof, there are shown inventions concerning the construction of standard pockets with the aid of adhesives. Heretofore, however, adhesives have not been employed in the construction of patch pockets or flaps. There is thus a need for patch pocket and flap constructions which utilize adhesive connection techniques to reduce garment production costs.

DISCLOSURE OF INVENTION

The present invention comprises a method of constructing patch pockets and flaps for garments which overcomes the foregoing and other problems associated with the prior art. In accordance with the broader aspects of the invention, a patch pocket blank is provided with adhesive adjacent to the bottom and side edges. The patch pocket blank is then positioned against the garment followed by activation of the adhesive to secure the blank to the garment, forming a patch pocket. If desired, a flap can also be attached to the garment. A flap blank is provided with adhesive adjacent to the top edge. Following positioning of the flap blank against the garment the adhesive is activated to secure the blank to the garment, forming a flap. A stitch can be sewn through the secured periphery of either the patch pocket or flap for reinforcement and a finished appearance.

In accordance with more specific aspects of the invention, a method of constructing patch pockets begins with the provision of a patch pocket blank. Fusible adhesive material is then deposited adjacent to the bottom and side edges of the obverse side of the patch pocket blank. The adhesive can be deposited in strip form or in the form of fusible thread in a covering stitch.

According to the preferred construction, the bottom and side edges of the patch pocket blank are then folded inwardly to orient the adhesive in the reverse direction. Alternatively, the adhesive can be provided on the reverse side of the patch pocket blank to eliminate the step of folding the edges which is required when the adhesive is provided on the obverse side.

The blank is then positioned reverse side against a garment wherein a patch pocket is desired. After positioning, the patch pocket blank is adhesively secured to the garment by activating the fusible adhesive material. Preferably, activation of the fusible adhesive material is effected by engaging the pocket blank with a heated press, ultrasonic means, or a radiant source capable of converting the adhesive from solid to plastic condition. If desired, a reinforcing stitch can be provided along the adhesively secured edges of the patch pocket.

If desired, a flap can be attached to the garment using similar techniques. Fusible adhesive material is deposited adjacent to the top edge of a flap blank. The adhesive can be attached to either side of the flap blank. Preferably, the adhesive is deposited on the obverse side, after which the top edge of the flap bank is folded inwardly to orient the adhesive in the reverse direction. The flap blank is then positioned reverse side against the garment, and the fusible adhesive material is activated to adhesively secure the flap in place. If desired, a reinforcing stitch through the top edge of the flap can be added.

BRIEF DESCRIPTION OF DRAWINGS

A more complete understanding of the invention can be had by reference to the following Detailed Description in conjunction with the accompanying Drawings, wherein.

DETAILED DESCRIPTION

Figure 1:
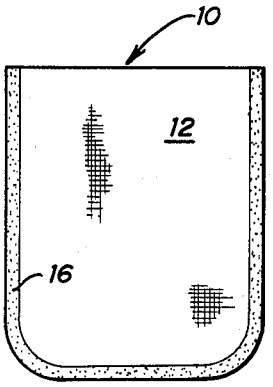
FIG. 1 is a plan view of one side of a patch pocket blank useful in the practice of the invention.

Referring now to the Drawings, wherein like reference numerals designate like or corresponding parts throughout the several views, there is illustrated a method of constructing patch pockets and flaps incorporating the invention. The patch pocket and flap constructions utilize fusible adhesive materials to eliminate several time-consuming and costly manual procedures which have been required heretofore. The method of the invention can be advantageously employed in the manufacture of shirts, trousers, jackets, or any other garment with patch pockets and/or flaps. The method reduces garment manufacturing costs and results in strong patch pocket and flap constructions of good looking appearance.

Figure 2:
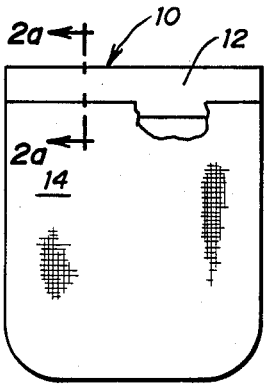
FIG. 2 is a plan view of the other side of the pocket blank shown in FIG. 1.

Referring to FIGS. 1 and 2, there is shown a patch pocket blank 10 which is used in the practice of the invention. Patch pocket blank 10 is shown in FIG. 1 with the obverse side up, the other or reverse side being up in FIG. 2. Patch pocket blank 10 is formed from a suitable piece of pocket material 12 of sufficient size to permit construction of the desired patch pocket. Typically, pocket material 12 comprises self goods matching the fabric of the garment. Material 12 can comprise any natural or synthetic cloth material suitable for use in the construction of a patch pocket. It will be understood that the exact composition of pocket material 12 is not critical to the practice of the invention.

For purposes of illustration, patch pocket blank 10 comprises a generally rectangular section of material 12 having rounded bottom corners. This is a popular shape for patch pockets. It will be understood that this particular shape is shown only for purposes of illustration, and that the method of the invention applies equally well to patch pockets of other peripheral shapes, such as those having square corners.

Figure 2A:
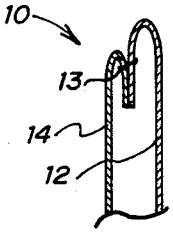
FIG. 2*a* is an enlarged partial sectional view taken generally along lines 2*a*—2*a* of FIG. 2 in the direction of the arrows.

As is best shown in FIGS. 2 and 2*a*, patch pocket blank 10 is illustrated with material 12 folded down at the top with a conventional liner 14 attached to the reverse side of the material. Preferably, the top edge of liner 14 is also folded down and secured to material 12. The folded top edges of material 12 and liner 14 are typically fastened together with a stitch 13. Adhesive could be utilized in place of stitch 13. It has been found that a liner material of the fusible type works well as liner 14. For example, material dot coated with adhesive on one side is easily attached to pocket material 12 in noncontinuous fashion. Patch pocket blank 10 is thus depicted with a typical rolled top edge and liner. It will be understood, however, that the method of the invention works equally well whether or not pocket blank 10 includes a rolled top edge or a liner 14. The particular construction of the patch pocket blank 10 is not critical to practice of the invention.

The material 12 is then provided with adhesive 16 adjacent to the bottom and side edges. Adhesive 16 is preferably located continuously about the lower periphery of pocket blank 10. Adhesive 16 can be provided on either the obverse or reverse side of material 12. FIG. 1 illustrates adhesive 16 positioned on the obverse side of pocket blank 10, which is in accordance with the preferred practice of the invention. If desired, adhesive 16 can be provided along the bottom and side edges of both sides of pocket blank 10. As shown in FIG. 1, adhesive 16 comprises a strip or ribbon of fusible material having a predetermined width. Adhesive 16 preferably comprises a fusible material, such as polyamide, nylon or polyester materials of the type manufactured by General Fabric Fusing Company of Cincinnati, Ohio. If desired, adhesive 16 can be extruded directly onto pocket material 12.

Figure 4:
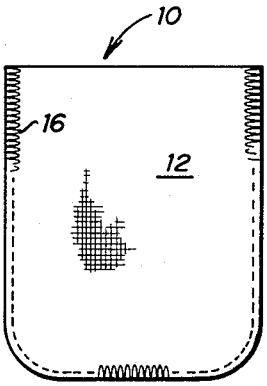
FIG. 4 is a plan view of one side of an alternate patch pocket blank.
Figure 5:
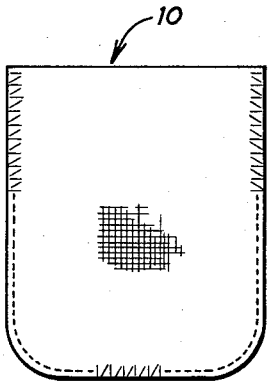
FIG. 5 is a plan view of the other side of the pocket blank shown in FIG. 4.

Referring to FIGS. 4 and 5, there is illustrated an alternate technique for providing patch pocket blank 10 with adhesive 16. If desired, adhesive 16 can be applied with a covering or overedging stitch. A serge stitch is one such stitch. A serge stitch is typically provided around the edges of a piece of fabric to prevent fraying. In a two-thread serge stitch, one or both of the threads can be formed of a fusible adhesive material, such as polyester, so that the adhesive is simultaneously attached during serging. FIG. 4 illustrates adhesive 16 attached only to the obverse side of pocket blank 10 by means of one fusible thread of a serge stitch, with the other non-fusible thread of the serge stitch being located on the reverse side shown in FIG. 5. It will be understood that adhesive 16 can be applied along the edges of both sides of patch pocket blank 10 with a serge stitch having both threads formed of fusible adhesive material.

Figure 3:
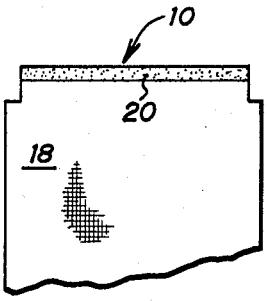
FIG. 3 is a partial plan view of an alternate form of the pocket blank shown in FIG. 1.
Figure 6:
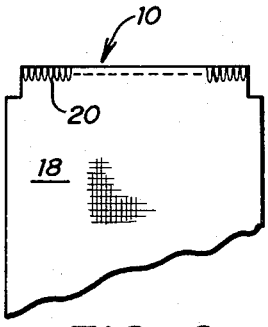
FIG. 6 is a partial plan view of a modification of the pocket blank shown in FIG. 4.
Figure 7:
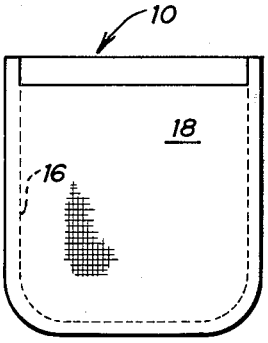
FIG. 7 is a plan view of the pocket blank modifications of FIGS. 3 and 6 after partial folding.

Referring now to FIGS. 3, 6 and 7, there is shown a modification of patch pocket blank 10. If desired, pocket blank 10 can be formed from a piece of material 18. The reverse side of material 18 faces up in FIGS. 3, 6 and 7. Adhesive 20 is next provided along the top edge of material 18 on the reverse side thereof. Adhesive 20 can be attached in the form of a strip of fusible adhesive material, as shown in FIG. 3, or in the form of adhesive thread in a serge stitch, as shown in FIG. 6. Adhesive 20 comprises a fusible adhesive material similar to that utilized for adhesive 16. The top edge of material 18 is then folded down as shown in FIG. 7 to position adhesive 20 between adjacent layers of material 18. As will be described more fully hereinafter, adhesive 20 is then activated to adhesively secure the rolled top edge of material 18. Preferably, the top corners of material 18 are notched as shown to allow for adhesive 16 when the top edge of material 18 is folded down.

Figure 8:
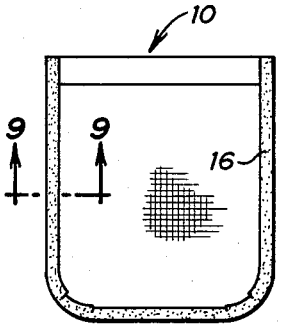
FIG. 8 is a plan view of a folded patch pocket blank.
Figure 9:
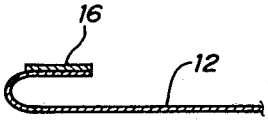
FIG. 9 is an enlarged sectional view taken generally along lines 9—9 of FIG. 8 in the direction of the arrows.

Referring to FIGS. 8 and 9, the bottom and side edges of patch pocket blank 10 are next folded inwardly in the preferred embodiment of the invention. The reverse side of pocket blank 10 faces up in FIG. 8. If adhesive 16 is positioned on the obverse side of pocket blank 10, the bottom and side edges are thus folded inwardly to orient the adhesive in the reverse direction. The use of adhesive 16 adjacent to the bottom and side edges minimizes the amount of turnunder required, resulting in less puckering and material waste. It will be understood that if adhesive 16 is applied to the reverse side of pocket blank 10, then the inward folding of the bottom and side edges is unnecessary.

Figure 10:
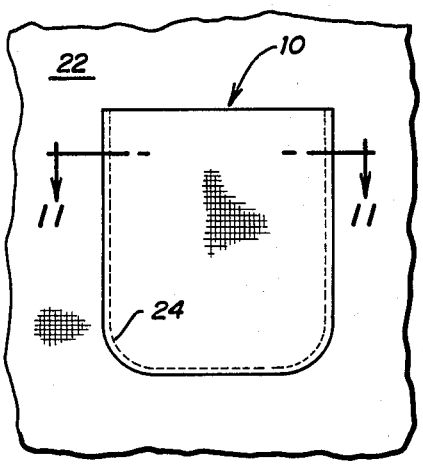
FIG. 10 is an illustration of a garment having a patch pocket constructed in accordance with the invention.
Figure 11:
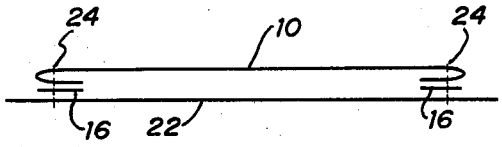
FIG. 11 is a sectional view taken generally along lines 11—11 of FIG. 10 in the direction of the arrows.

Referring to FIGS. 10 and 11, patch pocket blank 10 is next positioned on the outside of a garment 22 wherein a patch pocket is desired. For example, garment 22 can comprise a shirt, trousers, jacket or the like. Garment 22 can be formed of any natural or synthetic cloth material, the exact composition of which is not critical to the practice of the invention. The reverse side of patch pocket blank 10 is positioned against the outside surface of garment 22 with adhesive 16 therebetween. In the preferred embodiment of the invention, the bottom and side edges of patch pocket blank 10 are folded inwardly to properly orient adhesive 16. Of course, if adhesive 16 is provided along the edges of both sides of pocket blank 10, then adhesive will be positioned between adjacent layers of the pocket blank as well as between garment 22 and the pocket blank.

After positioning, the patch pocket blank 10 is adhesively secured in place. Fusible adhesive 16 is activated to convert it from a solid to a plastic condition. Activation of adhesive 16, as well as adhesive 20 if desired, is preferably accomplished by engaging the obverse side of pocket blank 10 with a heated press, ultrasonic or microwave means, or a radiant source. The temperature and duration of engagement are sufficient to melt the adhesive so that adjacent portions of patch pocket blank 10 and garment 22 become permeated to form a bonded connection. It will be appreciated that the use of a heated press to activate adhesive 16 simultaneously presses the periphery of the patch pocket. After activation, it will be understood that the patch pocket is secured with an adhesive connection which is strong and durable as well as resistant to garment cleaning processes. Preferably, a stitch 24 is sewn along the lower periphery of the patch pocket to reinforce the connection between pocket blank 10 and garment 22, and to lend a finished appearance to the patch pocket.

Figure 12:
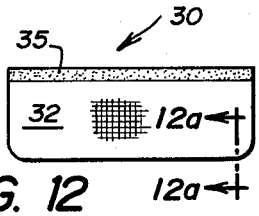
FIG. 12 is a plan view of one side of a flap blank useful in the practice of the invention.
Figure 13:
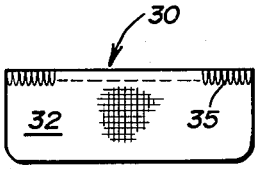
FIG. 13 is a plan view of one side of an alternate flap blank.
Figure 12A:
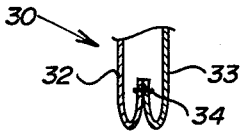
FIG. 12*a* is an enlarged partial sectional view taken generally along lines 12*a*—12*a* of FIG. 12 in the direction of the arrows.

Referring now to FIGS. 12, 12*a* and 13, there is shown a flap blank 30 which can be used in adding a flap to the patch pocket hereinabove described, if desired. Flap blank 30 can be formed of a single piece of flap material 32 comprising any natural or synthetic cloth material suitable for such use. Typically, however, the flap blank 30 comprises two pieces of material 32 and 33. The bottom edges of material 32 and 33 are folded inward and fastened together with a stitch 34 as is best shown in FIG. 12*a*. Adhesive can be used in place of stitch 34, if desired. The exact composition of pieces of flap material 32 and 33 is not critical to the practice of the invention. It will be understood that the particular construction of flap blank 30 is not critical to the invention.

The flap construction is carried out using techniques similar to the patch pocket construction. Adhesive 35 is deposited adjacent to the top edge of flap blank 30. Adhesive 35 comprises a fusible adhesive material such as polyamide, nylon, polyester or the like. Adhesive 35 can be applied in the form of a strip of material, as shown in FIG. 12, or in the form of a thread of fusible material in a serge stitch, as shown in FIG. 13. In accordance with the preferred embodiment of the flap construction, adhesive 35 is provided on the obverse side of flap material 32. If desired, adhesive 35 can be provided along the top edge of both sides of flap material 32, or only on the reverse side thereof.

Figure 14:
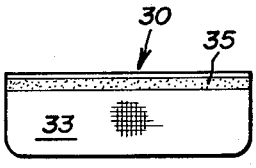
FIG. 14 is a plan view of a flap blank after folding.

Referring to FIG. 14, the top edge of the preferred embodiment of flap blank 30 is folded downwardly to orient adhesive 35 in the reverse direction. The reverse side of flap blank 30 faces up in FIG. 14. If adhesive 35 is provided only on the reverse side of material 32, it will be apparent that downward folding of the top edge of pocket blank 30 is unnecessary.

Figure 15:
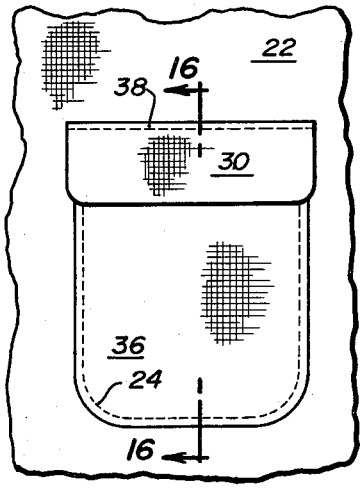
FIG. 15 is an illustration of a garment having a flap constructed in accordance with the invention.
Figure 16:
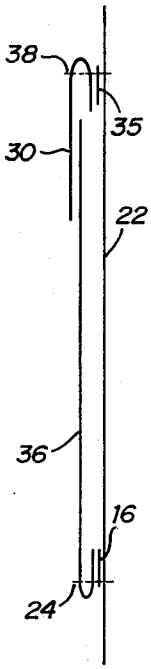
FIG. 16 is an enlarged sectional view taken generally along lines 16—16 of FIG. 15 in the direction of the arrows.

Referring to FIGS. 15 and 16, flap blank 30 is next positioned on garment 22 wherein a flap is desired. The reverse side of flap blank 30 is positioned against the outside surface of garment 22 with adhesive 35 therebetween. For purposes of illustration, flap blank 30 is shown in conjunction with a patch pocket 36 constructed according to the invention. Flap blank 30 is thus located on garment 22 so as to cover the top end of patch pocket 36. However, it will be appreciated that flap blank 30 is a separate component which can be added to garment 22 with or without an accompanying patch pocket.

After location, the flap blank 30 is adhesively secured in place. Adhesive 35 is activated with a heated press, ultrasonic or microwave means, or a radiant source to securely bond flap blank 30 to garment 22. The use of a heated press is desirable because it presses the folded top edge of pocket blank 30 during activation of adhesive 35. Preferably, a stitch 38 is sewn along the upper edge of the flap to give it an attractive appearanceand to reinforce the connection between flap blank 30 and garment 22.

In view of the foregoing description, it will be understood that the present invention comprises a method of constructing patch pockets and flaps which incorporates numerous advantages over the prior art. One important advantage involves the use of fusible adhesive materials in place of traditional sewing operations. Sewn patch pockets have heretofore required more material turned under along the edges, resulting in unsightly puckering and additional manual steps to correct the puckering. Also there is greater material waste when more turnunder is required. The use of fusible adhesives minimizes both material turnunder and puckering therefrom, and eliminates several manual operations which were heretofore required in the construction of patch pockets and flaps. Other advantages from the use of the invention will readily suggest themselves to those skilled in the art.

Although particular embodiments of the invention have been illustrated in the accompanying Drawings and described in the foregoing Detailed Description, it will be understood that the present application is not limited to the embodiments disclosed but is intended to embrace any alternatives, modifications, rearrangements and substitutions of parts and/or elements as fall within the spirit and scope of the invention.

We claim:

1. A method of constructing a patch pocket on a garment including the steps of:

providing a layer of pocket material characterized by side edges spaced apart a predetermined distance and a bottom edge interconnecting the side edges, the side edges and the bottom edge of the layer of pocket material having a predetermined shape;

providing a layer of liner material characterized by side edges spaced apart substantially the same distance as the side edges of the layer of pocket material and a bottom edge interconnecting the side edges, the side edges and the bottom edge of the layer of liner material having substantially the same shape as that of the layer of pocket material;

adhesively joining the layer of liner material to the inside surface of the layer of pocket material with the side and bottom edges of the layer of liner material extending substantially coextensively with the side and bottom edges of the layer of pocket material;

the joined layers of pocket material and liner material forming a patch pocket blank having an obverse side comprising the outside surface of the layer of pocket material and a reverse side comprising the layer of liner material;

securing a layer of fusible adhesive to the obverse side of the patch pocket blank adjacent to the side and bottom edges of the layer of pocket material;

folding the side and bottom edges of the patch pocket blank having the fusible adhesive thereon inwardly so that the fusible adhesive faces in the direction of the reverse side of the patch pocket blank;

positioning the folded patch pocket blank on the outside surface of the garment with the fusible adhesive engaging the outside surface of the garment and with the reverse side of the patch pocket blank positioned adjacent to the garment; and activating the fusible adhesive to secure the patch pocket blank to the outside surface of the garment.

2. The method of constructing a patch pocket according to claim 1 wherein the step of securing fusible adhesive to the patch pocket blank is carried out by depositing a strip of fusible adhesive on the obverse side of the patch pocket blank along the side and bottom edges thereof.

3. The method of forming a patch pocket according to claim 1 wherein the step of securing fusible adhesive to the patch pocket blank is carried out by forming a stitch along the side and bottom edges of the patch pocket blank, said stitch including at least one thread comprising a fusible adhesive.

4. A method of constructing a patch pocket on a garment including the steps of:

providing a layer of pocket material having opposed side edges spaced apart a predetermined distance, a bottom edge interconnecting the side edges, and an upper edge including an extension extending upwardly beyond the upper ends of the side edges and having a width less than the space in between the side edges;

folding the extension downwardly down along a line extending between the upper ends of the side edges;

adhesively securing the extension in the folded condition to define a folded top edge of the pocket blank;

said layer of pocket material having the extension folded and adhesively secured defining a patch pocket blank including a reverse side comprising the side having the extension secured thereto and an obverse side comprising the opposite side thereof;

attaching fusible adhesive to the obverse side of the patch pocket blank along the side and bottom edges thereof;

folding the side and bottom edges of the patch pocket blank inwardly so that the fusible adhesive attached thereto faces in the direction of the reverse side of the patch pocket blank;

positioning the patch pocket blank on the outside surface of a garment with the fusible adhesive engaging the outside surface of the garment and with the reverse side of the patch pocket blank positioned adjacent thereto; and activating the fusible adhesive to secure the patch pocket blank in engagement with the outside surface with the garment being carried out by forming a stitch along the side and bottom edges along the patch pocket blank, said stitch including at least one thread comprising a fusible adhesive.

* * * * *